US011495198B1

(12) United States Patent
Jackson

(10) Patent No.: US 11,495,198 B1
(45) Date of Patent: Nov. 8, 2022

(54) THUMB BAR CONTROLLER

(71) Applicant: Craig Eliot Jackson, Clearwater, FL (US)

(72) Inventor: Craig Eliot Jackson, Clearwater, FL (US)

( * ) Notice: Subject to any disclaimer, the term of this patent is extended or adjusted under 35 U.S.C. 154(b) by 0 days.

(21) Appl. No.: 17/324,683

(22) Filed: May 19, 2021

(51) Int. Cl.
*G10H 1/34* (2006.01)
*G10H 5/00* (2006.01)

(52) U.S. Cl.
CPC ..... *G10H 1/34* (2013.01); *G10H 5/002* (2013.01); *G10H 2220/275* (2013.01)

(58) Field of Classification Search
CPC ..... G10H 1/0066; G10H 1/00; G10H 1/348; G10H 1/36; G10H 1/42; G10H 1/0091; G10H 2210/155; G10H 2230/365; G10H 2220/221; G10H 1/32; G10H 1/18; G10H 2210/005; G10H 7/008; G10H 1/0016; G10H 1/02; G10H 1/186; G10H 2210/201; G10H 2210/221; G10H 2210/171; G10D 13/08; G10D 3/08; G10G 1/00; G10C 3/12; G10C 5/10
See application file for complete search history.

(56) References Cited

U.S. PATENT DOCUMENTS 4,915,002 A * 4/1990 Dornes ..... G10H 1/0558 84/692
4,966,053 A * 10/1990 Dornes ..... G10H 1/0553 84/453
5,082,258 A * 1/1992 Niks ..... A63B 23/16 482/47
2015/0310762 A1* 10/2015 Seim ..... G09B 15/00 434/113

* cited by examiner

*Primary Examiner* — Marlon T Fletcher

(57) ABSTRACT

The Thumb Bar Controller is a bar that runs the width of the electronic musical keyboard playing area, (plus whatever is needed for the lever attachment), connected by two armsrests just below the top, and approximately one inch away from the keys. It gives the performer control over two (or more) functions with the thumb of the playing hand, that would otherwise require the other hand or foot pedals, allowing a person with the disability of one arm/hand, to be as proficient as a person with two. It can be used for controlling pitch bend, modulation, MIDI specification controllers, various electronic controls, and product specific controls.
The bar can be attached in numerous ways, could use a variety of spring type mechanisms to control it. It can be mounted externally or made as an integral part of the keyboard, with openings for the bar connections and movement required.

2 Claims, 11 Drawing Sheets

(Fig.1)
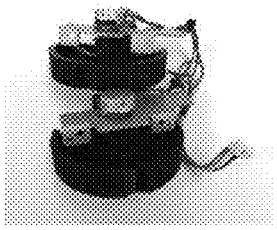
(Fig.1a)
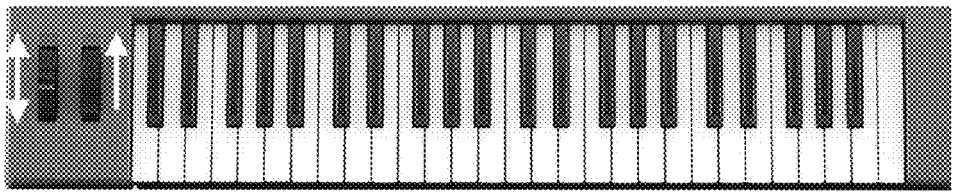
(Fig.2)
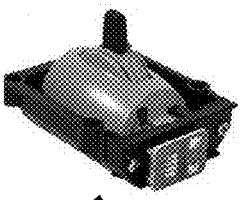
(Fig.2a)
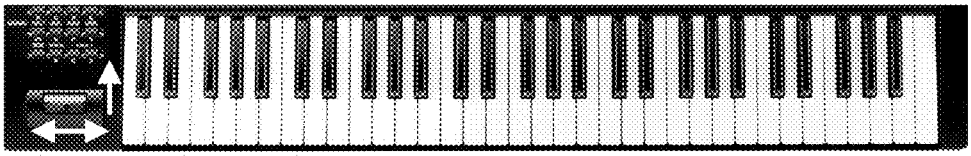
Typical electronic musical keyboard instrument without Thumb Bar Controller.
(Fig.2b)
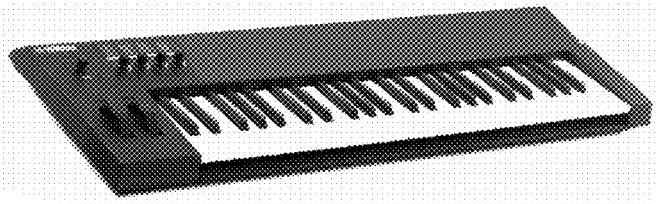

*(Fig. 3)*
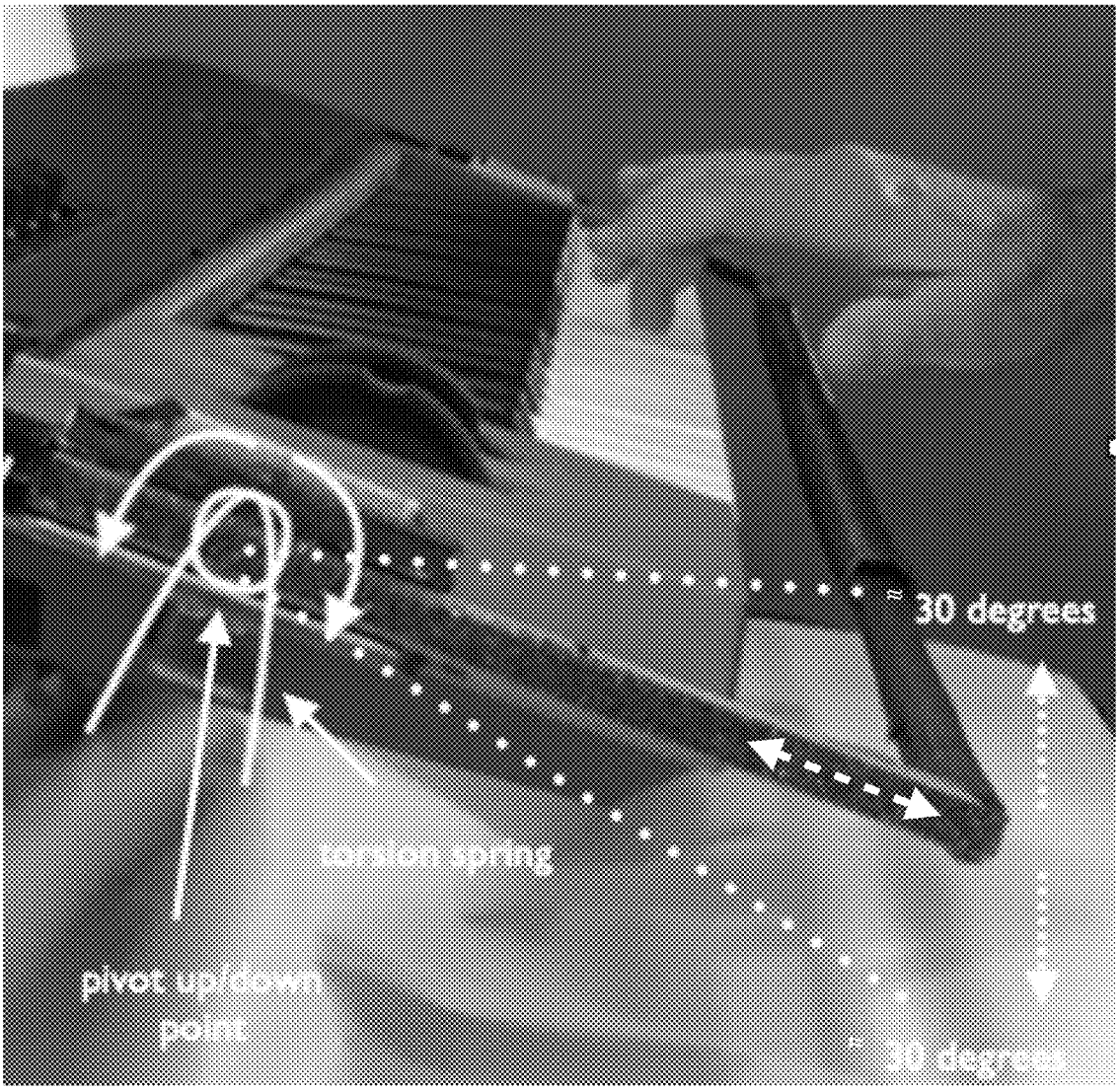

(Fig. 4)
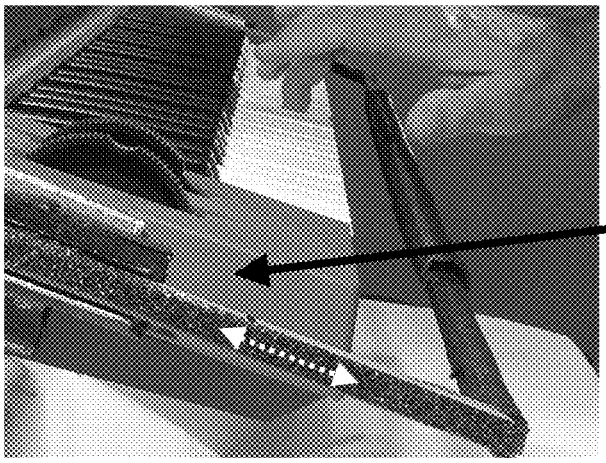
Telescoping levers on both sides of keyboard for manipulation of electronic components and connected to Thumb Bar Controller
(Fig.5)
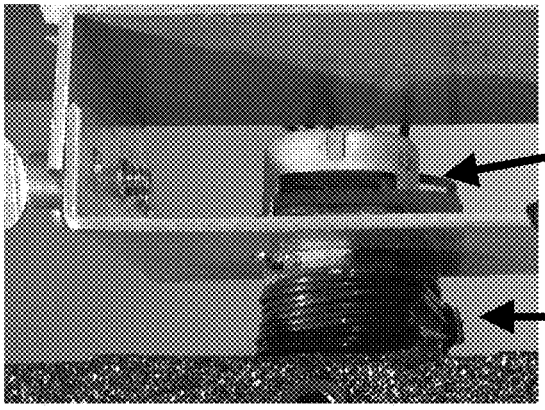
(Fig.5a)
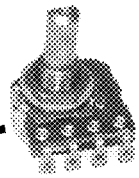
Center tap 10 Kohm potentiometer
(Fig.5b)
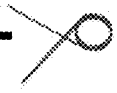
Torsion spring - Used to hold potentiometer in center position and return it to that position after pressure is released.
(Fig.6)
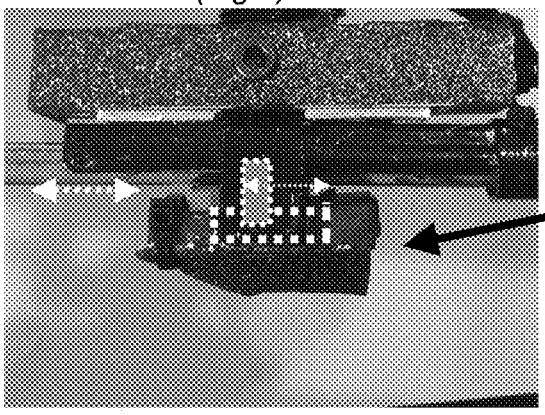
(Fig.6a)
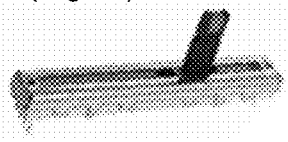
20mm 10 Kohm sliding potentiometer

NEUTRAL POSITION - Bar rests at center and out position
*(Fig.7)*
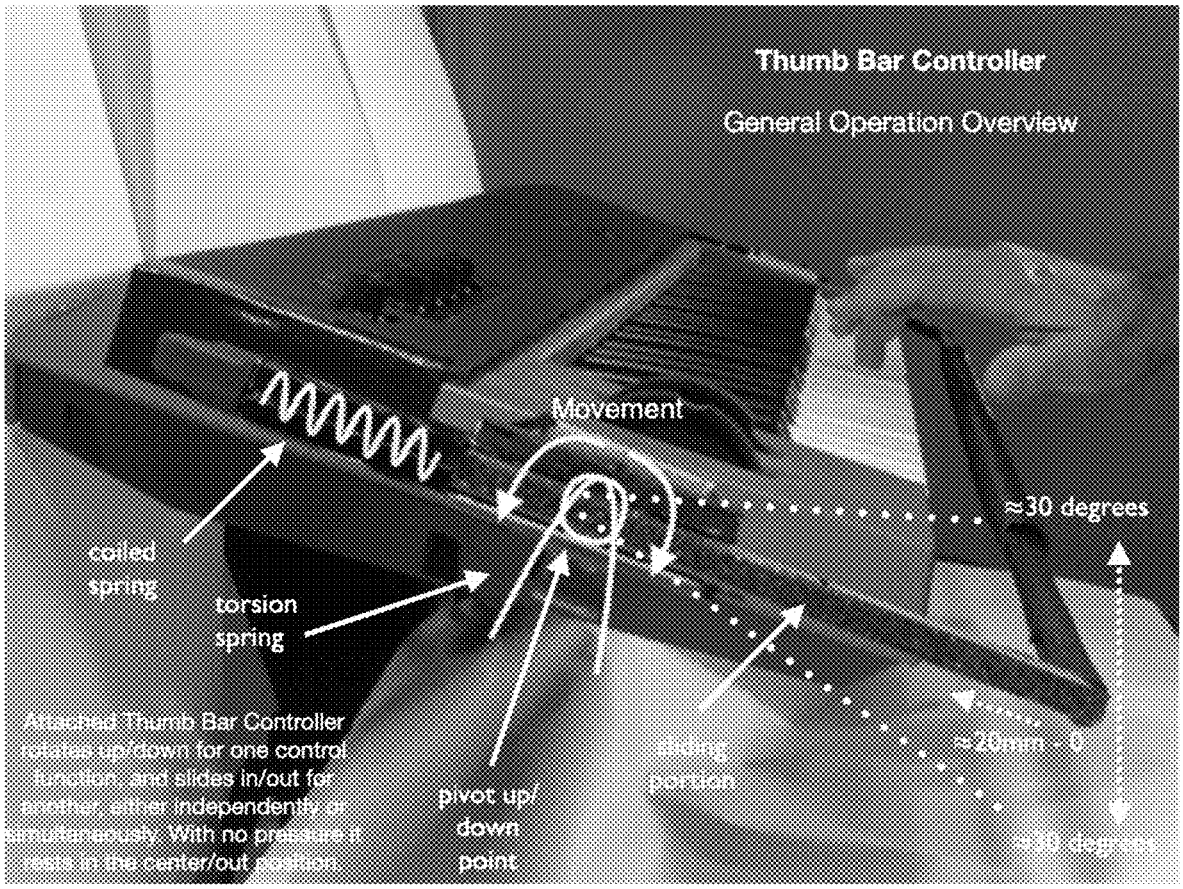

(Fig. 8)
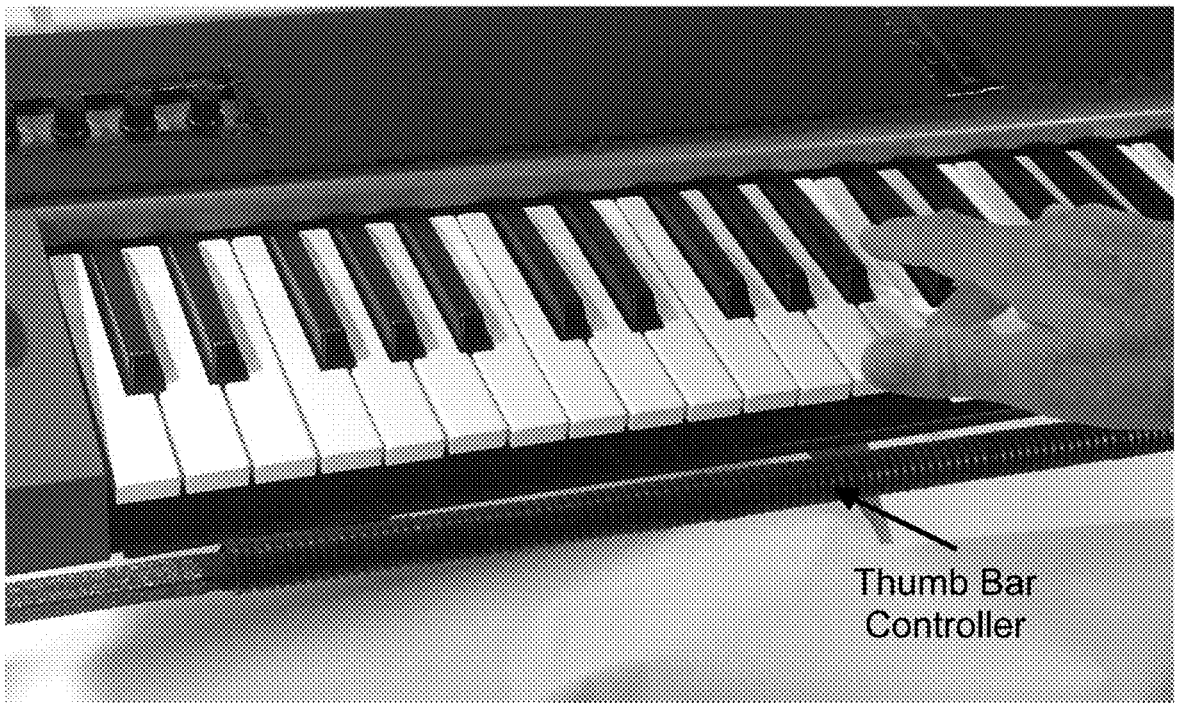
(Fig. 9)
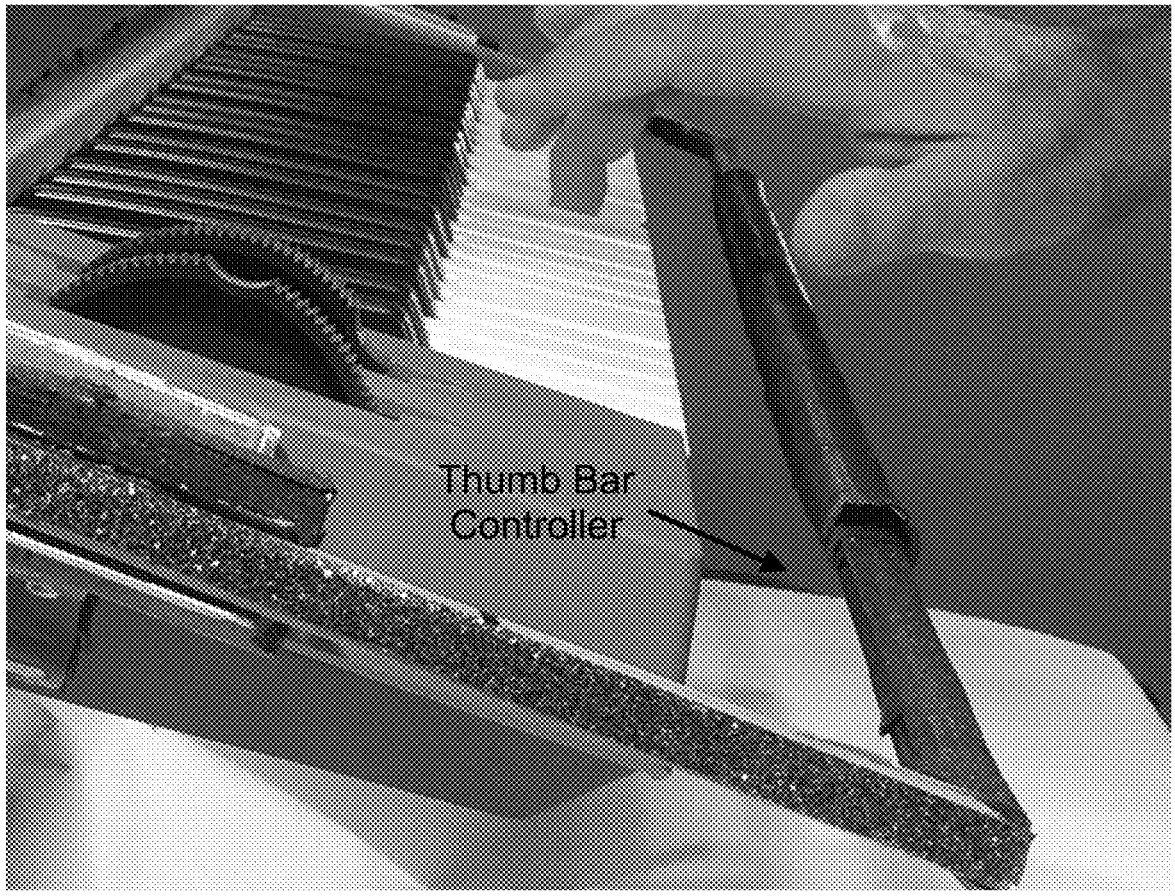

(Fig. 10)
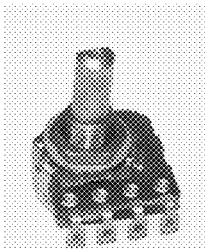
(Fig. 10a)
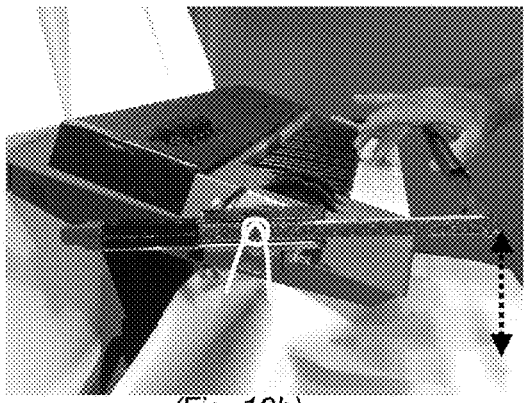
(Fig. 10d)
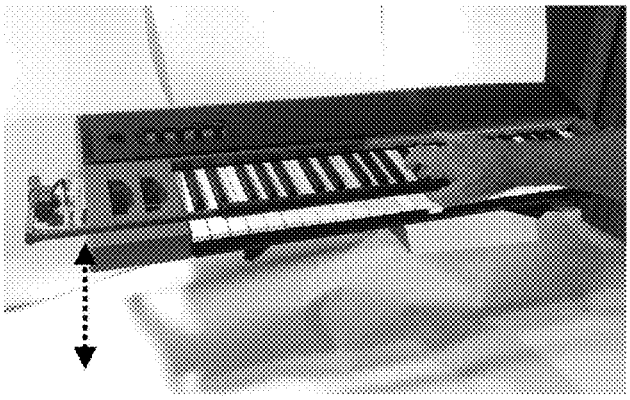
(Fig. 10b)
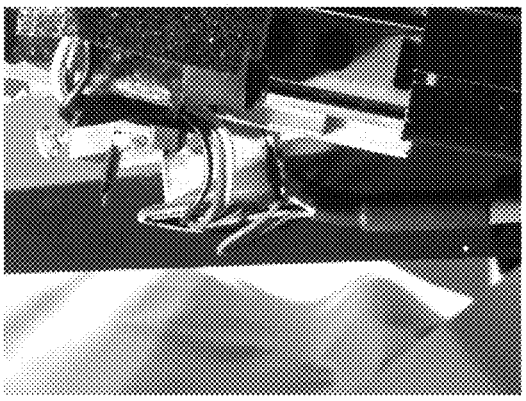
(Fig. 10c)
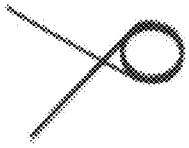
Torsion spring - Used to hold potentiometer in center position and return it to that position after pressure is released.

(Fig. 11)
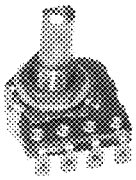
(Fig. 11a)
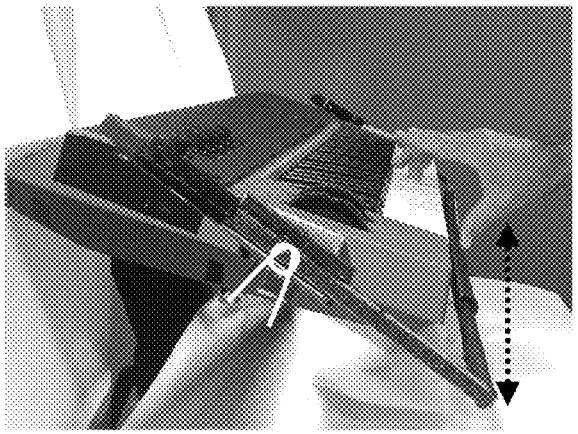
(Fig. 11d)
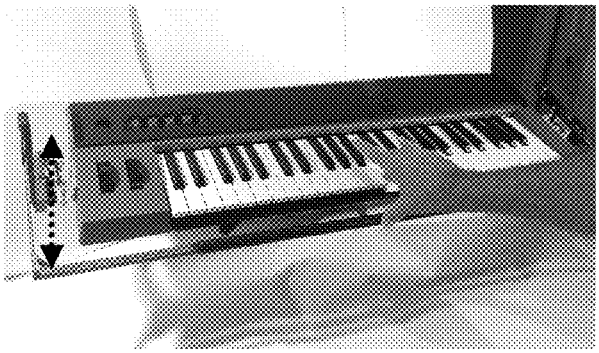
(Fig. 11b)
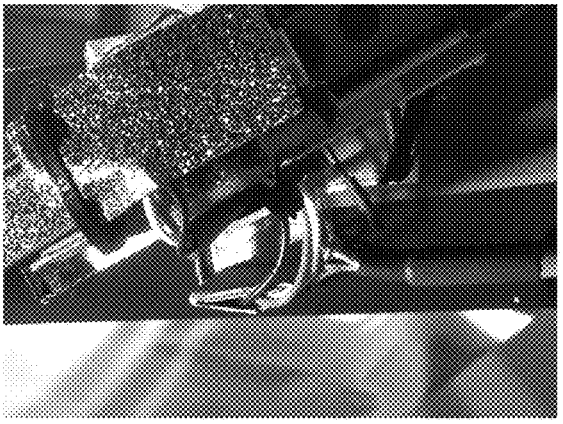
(Fig. 11c)
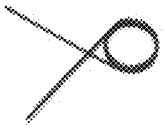

(Fig. 12)
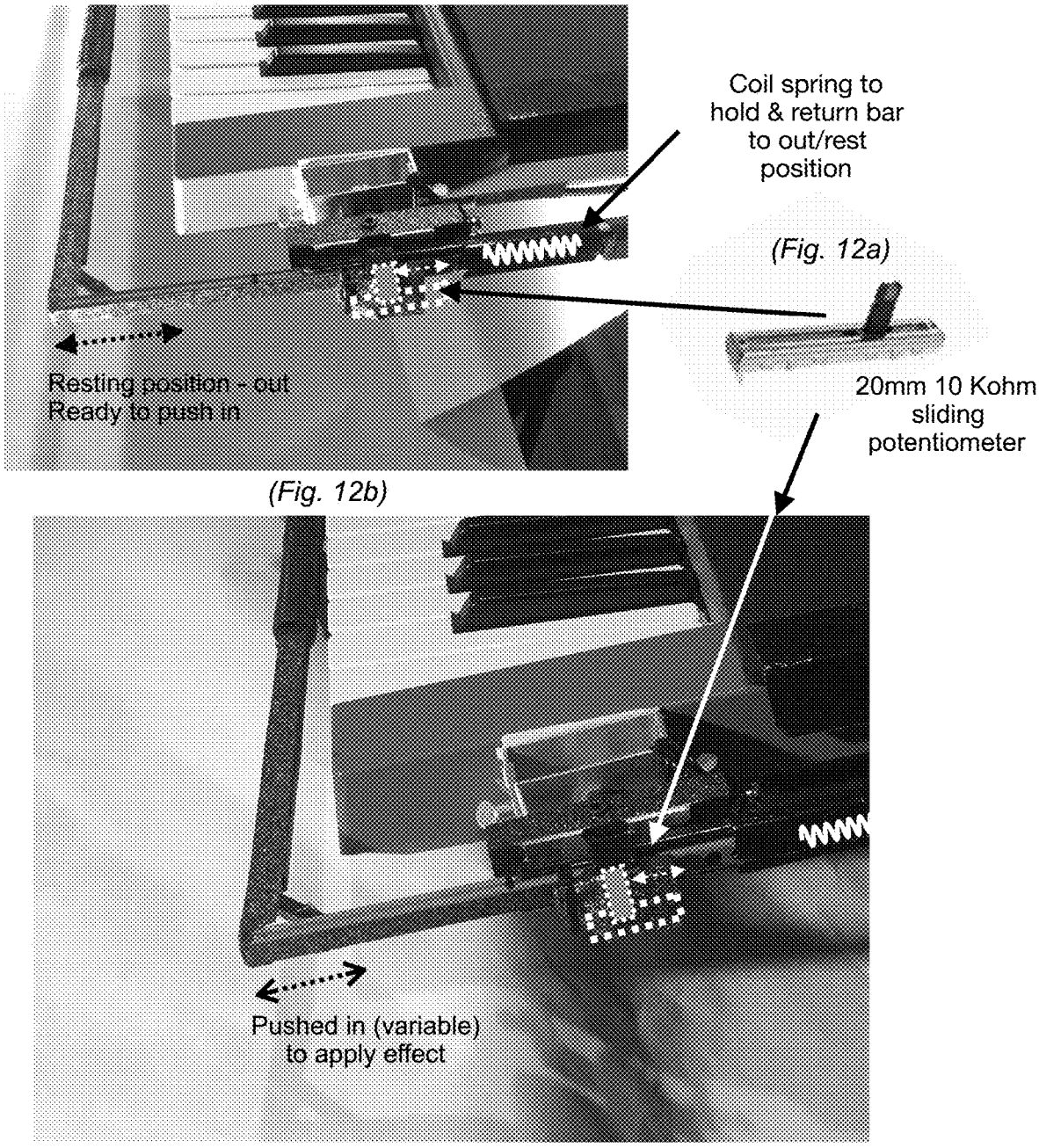

(Fig. 13)
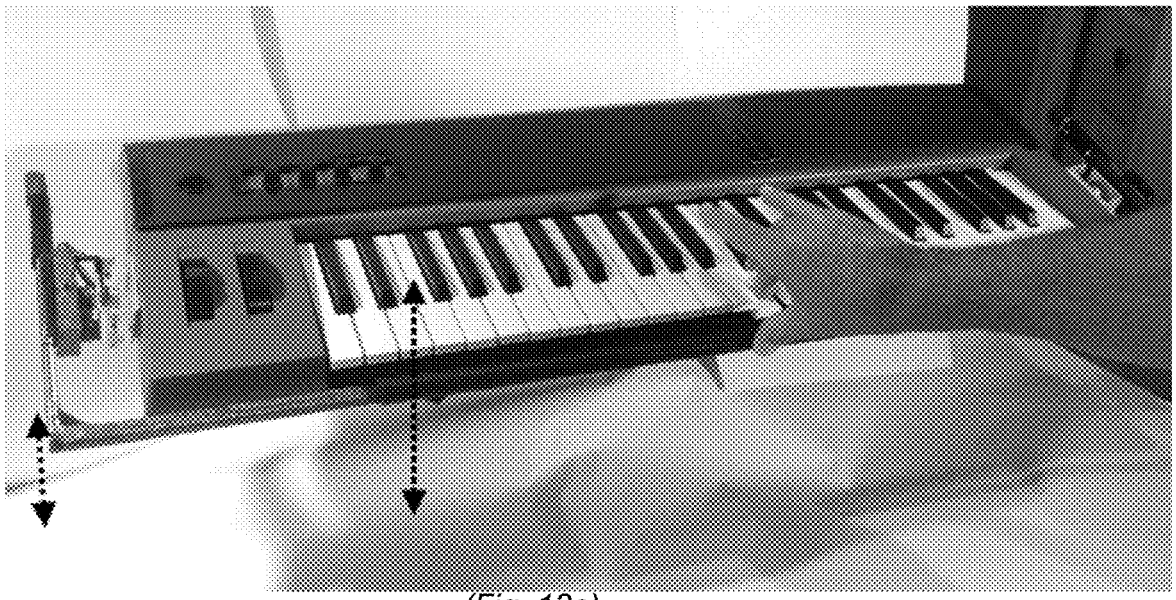
(Fig. 13a)
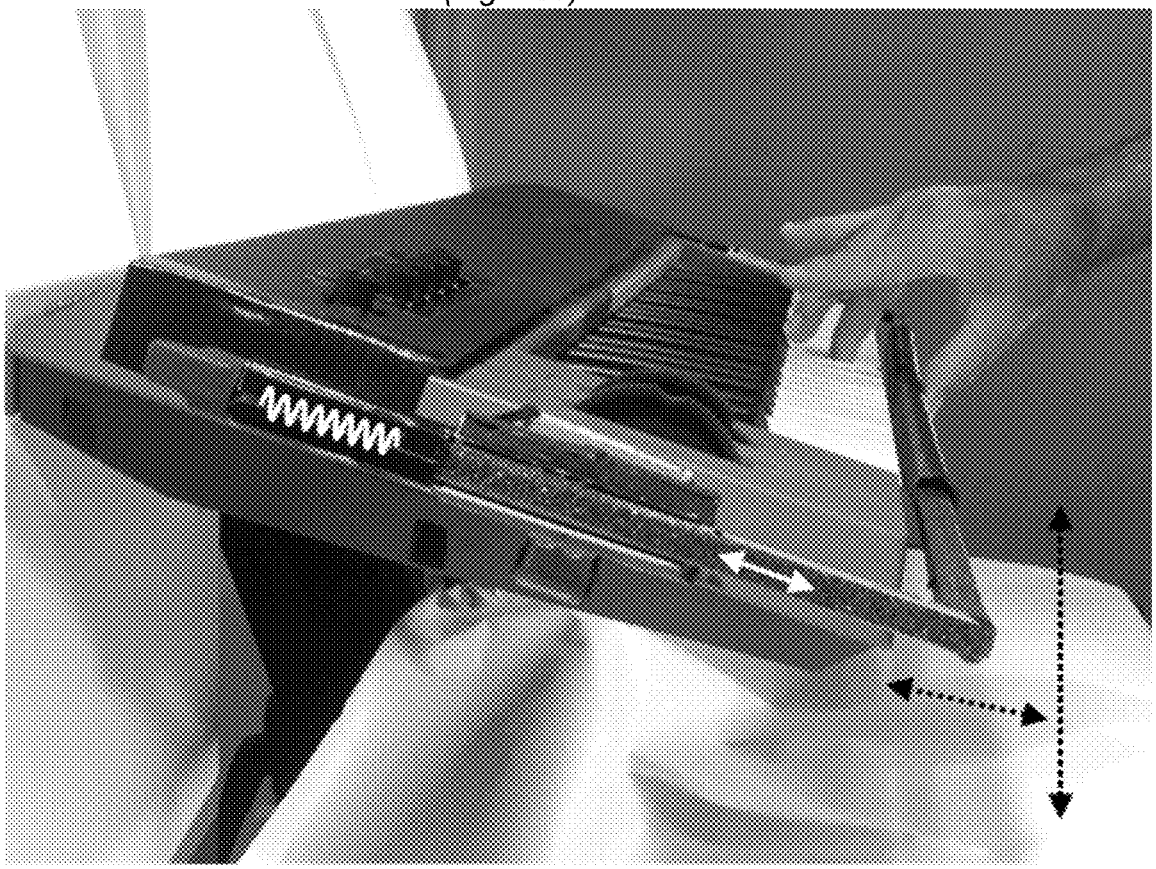

(Fig. 14)
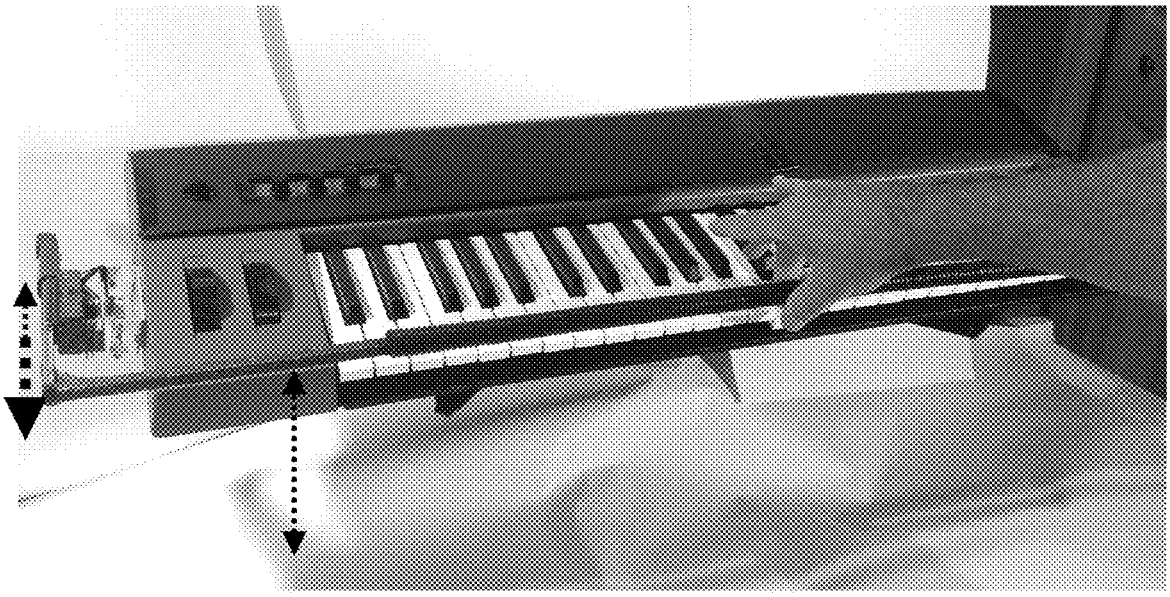
(Fig. 14a)
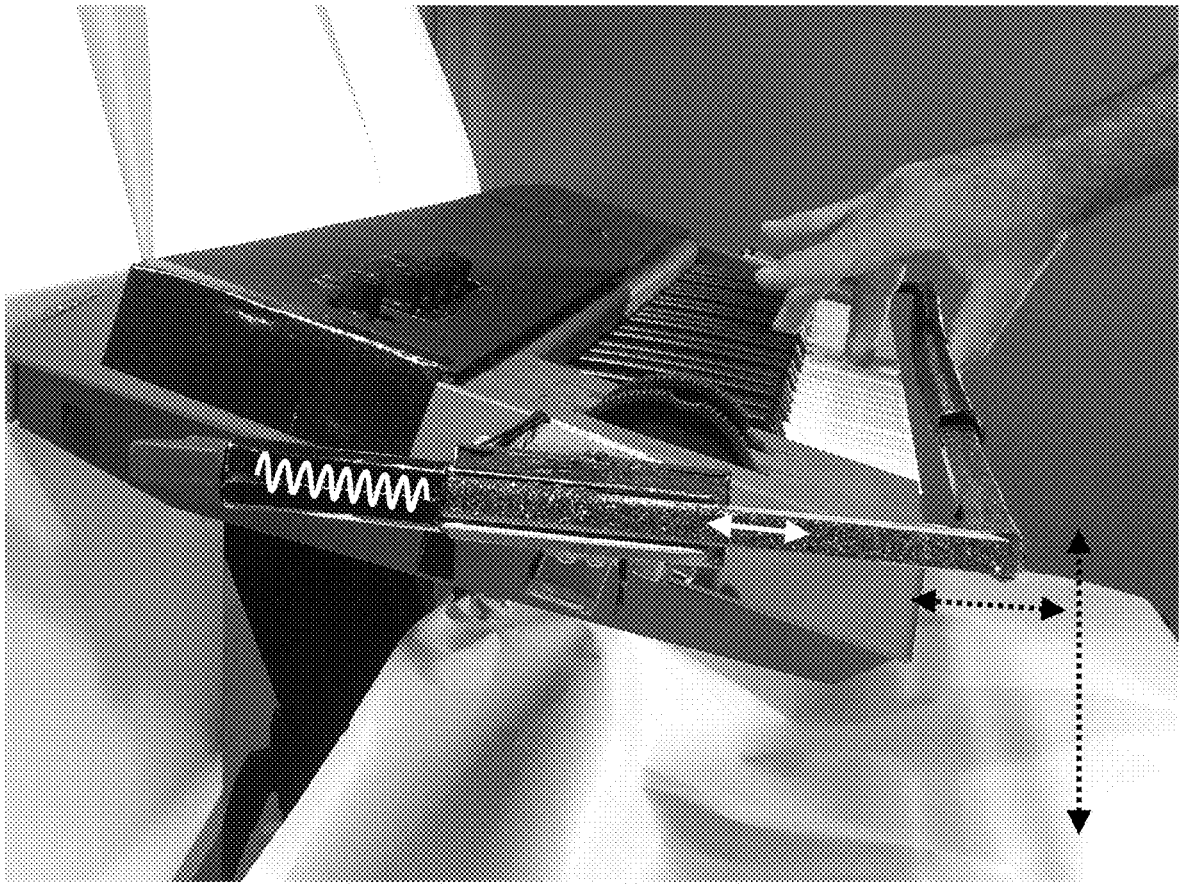

(Fig. 15)
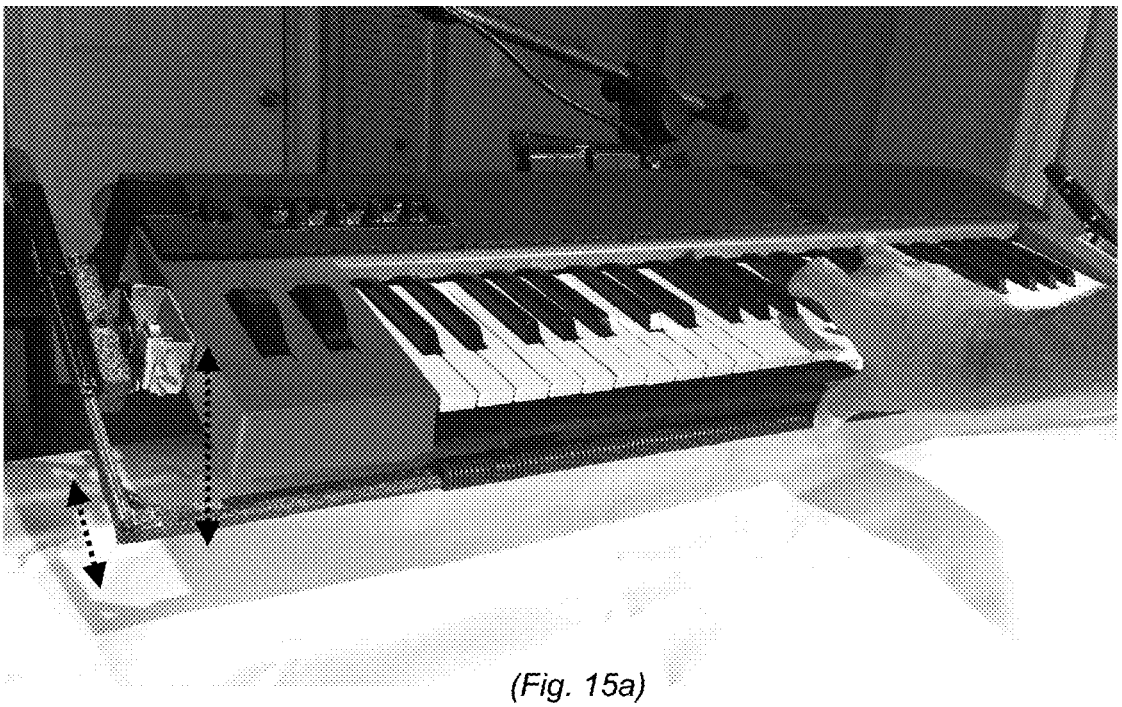
(Fig. 15a)
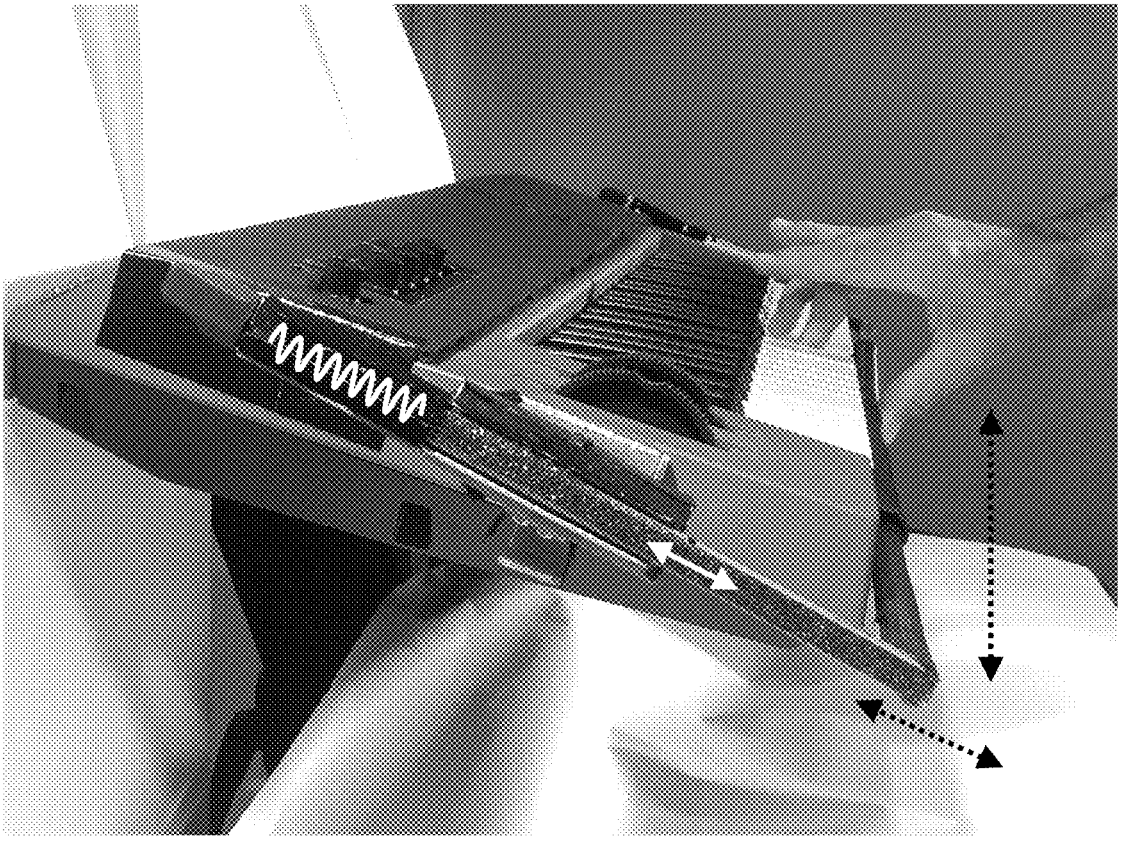

THUMB BAR CONTROLLER

CROSS-REFERENCE TO RELATED APPLICATIONS (NOT APPLICABLE)

STATEMENT REGARDING FEDERALLY SPONSORED RESEARCH OR DEVELOPMENT (NOT APPLICABLE)

REFERENCE TO SEQUENCE LISTING, A TABLE, OR A COMPUTER PROGRAM LISTING COMPACT DISC APPENDIX (NOT APPLICABLE)

THE NAMES OF THE PARTIES TO A JOINT RESEARCH AGREEMENT (NOT APPLICABLE)

BACKGROUND OF THE INVENTION

Field

Bar for controlling pitch, assignable MIDI functions, and product specific controls on an electronic musical keyboard with thumb

Problem Solved

For over 50 years most electronic music synthesizers have used two wheels (FIG. 1) or a joystick type of controller (FIG. 2) on the left side (FIG. 1*a*, 2*a* & 2*b*) of the keyboard for manually changing the pitch (up and down), and adding MIDI effects such as modulation, tone, resonance, etc., while performing. Many of these keyboards are generally used for solos, and are played with the right hand only, but require the left hand to operate these controllers for articulation. Many musicians play multiple keyboards, and do not have a hand to spare. Keyboards already have numerous foot pedals for normal performance, so that is not really an option, and is also less precise for these effects.

My invention allows the performer to use the thumb of his playing hand to control both of these operations, leaving the other hand for playing another keyboard, visual expression, communication or direction, or other technical adjustments. More importantly, it allows a disabled person, with only one arm, to be just as proficient, as a person with two.

The working prototype that I have presented in this document, has electronic controls that correspond to this particular manufacturer, is attached externally, and is patched into the existing pitch bend/mod wheel circuit, replacing the existing wheel controls. It still allows for detailed editing of the parameters through the keyboard's control system, as it did for the original control wheels.

This is an improvement of abandoned PROVISIONAL PATENT No. 62/244,564 filed by Craig Eliot Jackson on Oct. 21, 2015.

A new PROVISIONAL Application No. 63/145,566 was filed on Feb. 4, 2021. It allows for control over two functions simultaneously, where as the previous version allowed only one.

Related Art

1. U.S. Pat. No. 4,915,002
   MUSIC SYNTHESIZER ADJUNCT
   This bar type controller require would major modifications to past and current electronic keyboards to be installed. As keyboards vary in the size of chassis/cabinet for the number of keys that it contains, this would require manufacturing many more parts to install this device.

2. U.S. Pat. No. 4,966,053
   MUSIC SYNTHESIZER WITH MULTIPLE MOVABLE BARS
   This bar type controller would also require would major modifications to past and current electronic keyboards to be installed. As keyboards vary in the size of chassis/cabinet for the number of keys that it contains, this would require manufacturing many more parts to install this device.
3. United States Patent Application Publication US 2015/0310762 A1
   METHODS, SYSTEMS, AND APPARATUSES TO CONVEY CHORDED INPUT
   This device has no common design, function, or operational characteristics to the THUMB BAR CONTROLLER.

BRIEF SUMMARY OF THE INVENTION

Electronic keyboards are able to create new and mimic natural, unnatural, industrial, electronic and musical sounds. There are other factors other than the initial sound that is made by playing a key on a keyboard, that sometimes need to be controlled. The Thumb Bar Controller allows for controlling pitch, adding vibrato, changing tonal quality, and changing many other functions of the sound that need to be controlled without the use of the other hand or a foot. This is important, as many keyboard performers play multiple keyboards, use feet for other devices, or may only have the use of one hand when playing the keyboard.

The Thumb Bar Controller (FIG. 3) is non-specific in size, dimensions or shape, so that it may be developed for most any manufacturer's synthesizer. It runs the width of the keyboard playing area, (plus whatever is needed for the lever attachment), rests horizontally just below the top of the keys, and approximately one inch away from the keys, where it does not interfere with normal performance, and is convenient for the performer's thumb to move it, up, down (Y axis), and/or, in and out (X axis).

It is most suitable for forty-nine key or less synthesizers, that are mainly used for solo performance and generally played with only one hand, but is not exclusive to these types. Because of the amazing strength and control of the human thumb, this makes for remarkably precise adjustments. It is also more natural, as musical sound articulation is often applied when sustaining a note.

The Thumb Bar controller rests in the center and out position in front of the keyboard, through the use of spring mechanisms on telescoping levers connected on each end, where it produces no change, unless specifically programmed to do otherwise in the operating system of the keyboard. The telescoping levers (FIG. 4) are connected to a rotary potentiometer or digital encoder (FIG. 5) for the Y axis controller, and a sliding potentiometer or digital encoder (FIG. 6) for the X axis controller, allowing the performer to simulataneously change two different control voltages (or any type of electronic control signal), while performing, with the use of his or her thumb on the playing hand.

I have presented a real world, operational, proof or concept prototype, built with available materials from the hardware store (FIG. 7). In some instances, I have used temporary sources of spring control, to avoid the expense of specific manufacturing/design parameters, to compensate for weight of materials.

The bar assembly can be attached in numerous ways, could use a variety of spring type mechanisms to control it in the fashion I present. It can be mounted externally and patched into the existing pitch bend/mod wheel circuit, replacing the existing wheel controls, or made as an integral part of the keyboard, with openings for the levers and movement required. It still allows for detailed editing of the parameters through the keyboard's control system, as it did for the original control wheels.

Because of the movement of the bar below the keyboard, the Thumb Bar Controller, may require some rethinking of how the keyboard is mounted, but the capabilities of this new controller far outweigh the traditional designs, and should spur some new designs in keyboard stands and accessories.

The MIDI spec provides hundreds of electronic control functions, for adding effects or articulating electronic and musical sounds, two of which can be programmed to be controlled with the Thumb Bar Controller. With the recent advent of MIDI 2.0, this allows many new capabilities for this new controller.

With the capabilities of injection molding, 3-D printing, and modern manufacturing techniques, there are certainly numerous ways of manufacturing this new type of control assembly.

With Bluetooth and other low power wireless transmitters and receivers being introduced, an attachable/removable version could be implemented by third party manufacturers, to conform to the keyboard manufacturer's specifications.

The Version of the Invention Discussed Here Includes

1. Thumb Bar Controller (cylindrical, square, flat, trapezoidal, irregular, textured for thumb)
2. Left and right telescoping controller levers
3. Rotary center tap control voltage potentiometer or encoder
4. Slide control voltage potentiometer or encoder
5. Connecting cables
6. Mounting plates
7. Coiled springs
8. Torsion springs
9. Screws

BRIEF DESCRIPTION OF THE DRAWINGS OF THE INVENTION (FIG. 1) Wheel type assembly for controlling pitch bend and MIDI effects.

(FIG. 1*a*) Wheel type assembly as mounted on left side of musical keyboard.

(FIG. 2) Joystick type assembly for controlling pitch bend and MIDI effects.

(FIG. 2*a*) Joystick type assembly as mounted on left side of musical keyboard.

(FIG. 2*b*) Typical electronic musical keyboard without Thumb Bar Controller.

(FIG. 3) Direction and range of movement. of Thumb Bar Controller.

(FIG. 4) Thumb Bar Controller connected to telescoping levers.

(FIG. 5) Levers attached to rotary potentiometer and held in position by spring.

(FIG. 5*a*) Center tap type rotary potentiometer.

(FIG. 5*b*) Torsion spring.

(FIG. 6) Levers attached to sliding potentiometer.

(FIG. 6*a*) Sliding potentiometer.

(FIG. 7) General Operation overview/Thumb Bar Controller at rest position.

(FIG. 8) Front view of Thumb Bar Controller.

(FIG. 9) Side view of Thumb Bar Controller.

(FIG. 10) Center tap type rotary potentiometer.

(FIG. 10*a*) Side view of Y axis movement up.

(FIG. 10*b*) Torsion spring in up position.

(FIG. 10*c*) Torsion spring.

(FIG. 10*d*) Front view of Y axis movement up.

(FIG. 11) Center tap type rotary potentiometer.

(FIG. 11*a*) Side view of Y axis movement down.

(FIG. 11*b*) Torsion spring in down position.

(FIG. 11*c*) Torsion spring.

(FIG. 11*d*) Front view of Y axis movement down.

(FIG. 12) Thumb Bar Controller at X axis rest showing sliding potentiometer.

(FIG. 12*a*) Sliding potentiometer.

(FIG. 12*b*) Thumb Bar Controller at X axis pushed in position.

(FIG. 13) Front view of Thumb Bar Controller at Center/In position.

(FIG. 13*a*) Side view of Thumb Bar Controller at Center/In position.

(FIG. 14) Front view of Thumb Bar Controller at Up/In position.

(FIG. 14*a*) Side view of Thumb Bar Controller at Up/In position.

(FIG. 15) Front view of Thumb Bar Controller at Down/In position.

(FIG. 15*a*) Side view of Thumb Bar Controller at Down/In position.

DETAILED DESCRIPTION OF THE INVENTION

The Thumb Bar Controller (FIG. 3) is non-specific in size, dimensions or shape, so that it may be developed for most any manufacturer's synthesizer keyboard. The Thumb Bar Controller runs the width of the keyboard playing area, rests horizontally just below the top of the keys, and approximately one inch away from the keys. It is most suitable for forty-nine key or less synthesizers, that are mainly used for solo performance and generally played with only one hand, but is not exclusive to these types. Because of the amazing strength and control of the human thumb, this makes for remarkably precise adjustments. It is also more natural, as musical sound articulation is often applied when sustaining a note.

The Thumb Bar Controller rests in a neutral position (center/out) (FIG. 7) below the top of the keys, by movable telescoping levers attached to each side of the keyboard, where it does not interfere with normal performance, is convenient for the performer's thumb to move it up or down (Y axis), and push it in (X axis), simultaneously (if desired). The Thumb Bar Controller rests in the neutral position, when no pressure is applied, through the use of spring or elastic mechanisms on each of the telescoping levers attached on each end (FIG. 7), where it produces no change in the control signals, unless specifically programmed to do otherwise in the operating system of the keyboard.

Each of the telescoping levers (FIG. 3, 4), on each end of the Thumb Bar Controller, are comprised of at least two parts, where part one is able to telescope into part two. Part one is connected to the Thumb Bar Controller perpendicularly at each end, while each of the other ends are connected to, but capable of a sliding movement of one inch on the x axis into, part two of the levers. On one side, the part one is connected to the wiper control of a sliding potentiometer or digital encoder (FIGS. 4, 6 & 6*a*) for changing a control voltage when pressure is applied to move the Thumbar Controller in, up to one inch towards the keyboard on the X axis. The Thumb Bar Controller is returned to its neutral position, when no pressure is applied, by a spring or elastic mechanism (FIG. 7, 12) connected between part one and two of the telescoping lever, returning the wiper control of a sliding potentiometer or digital encoder to its neutral position. Part two, of each of the two telescoping levers, (FIG. 3, 7) is mounted on an axle within the attachment mount to each side of the keyboard enclosure. When pressure is applied, the Thumbar Controller can move up or down (FIG. 3, 7) at least thirty degrees on the y axis. One part two is connected to the wiper control of a rotary potentiometer or digital encoder (FIGS. 5 & 5*a*) for changing a control voltage when pressure is applied to move the Thumbar Controller up or down. Each part two is returned to its neutral resting position, when no pressure is applied, (FIG. 3) by a spring or elastic mechanism, returning the Thumbar Controller and the wiper control of a rotary potentiometer or digital encoder to its neutral position. This allows the performer to simultaneously or independently change two different control voltages (or any type of electronic control signal), while performing, thereby adding subtle, natural, exciting or exotic articulations to an electronic sound, with his or her thumb of the playing hand.

The Thumb Bar Controller (FIG. 7) can be easily manufactured to work for a variety of keyboards, since it attaches externally to the keyboard enclosure, and can be connected into the existing pitch bend/mod wheel circuit, replacing the existing controls, or through connection by the MIDI specification.

This still allows for detailed editing of the parameters through the keyboard's control system, as it did for the original controls. Each of the control signals are variable, as determined by the settings under the parameters for these controls.

The Thumb Bar Controller (FIGS. 8 & 9) gives the performer control over two programmable functions with the thumb of the playing hand, that would otherwise require the other hand or foot pedals. A personal with the disability of having only one arm/hand, would still be able to be as proficient a person with two. It can be used for controlling pitch bend, modulation, MIDI specification controllers, various electronic controls, and product specific controls.

If desired, the Thumb Bar Controller (FIG. 7) can be manufactured as an integral part of the keyboard, with openings for the telescoping levers and their required movement.

NEUTRAL POSITION (center/out)—(FIG. 7) No change is produced in either of the two programmed effects controlled by the control voltages, controlled by the Thumbar Controller, unless specifically programmed at this position.

UP POSTION (variable)—Pitch of note or notes played raised as desired. A rotary potentiometer (FIG. 10) on one telescoping lever is held in its neutral position by torsion springs (FIG. 10*a*, 10*b*, 10*c*) on each side of part two of each of the telescoping levers, until lifting pressure (FIG. 10*d*) is applied to the Thumb Bar Controller to move it up. This rotates the wiper of the potentiometer and causes a change in the control voltage for a programmed effect, most commonly being Pitch Bend, allowing the performer to raise the pitch as desired. When pressure is released, the Thumb Bar Controller and rotary potentiometer each return to their neutral position, where pitch returns to normal.

DOWN POSTION (variable)—Pitch of note or notes played lowered as desired. The same rotary potentiometer (FIG. 11) is held in its neutral position by torsion springs (FIG. 11*a*, 11*b*, 11*c*) on part two of each of the telescoping levers until downward pressure (FIG. 11*d*) is applied to the Thumb Bar Controller to move it down. This rotates the wiper of the potentiometer and causes a change in the control voltage for a programmed effect, most commonly being Pitch Bend, allowing the performer to lower the pitch as desired. When pressure is released, the spring mechanism returns the Thumb Bar Controller and rotary potentiometer to their neutral position, where pitch returns to normal.

In (FIG. 12), the telescoping levers are in their neutral position, and part one of the two telescoping levers rests in the out position, applying no change. Applying pressure to push the Thumb Bar Controller in, towards the keyboard, moves the wiper of a slide potentiometer (FIG. 12*a*, 12*b*), and changes another control voltage controlling another MIDI effect. When pressure is released, a spring returns the Thumb Bar Controller back out to its neutral position, returning the wiper and other MIDI effect to its neutral position. This can be done independently or simultaneously to any movement made on the Y axis (up or down movement).

CENTER/IN POSTION (variable)—Pitch of note or notes played not changed, but other MIDI effect applied. (FIG. 13, 13*a*).

UP/IN POSTION (variable)—Pitch of note or notes played raised as desired, and other MIDI effect applied as desired. (FIG. 14, 14*a*)

DOWN/IN POSTION (variable)—Pitch of note or notes played lowered as desired, and other MIDI effect applied as desired. (FIG. 15, 15*a*)

What is claimed:

1. A Thumb Bar Controller for variable of a music synthesizer having a horizontally disposed keyboard, wherein said thumb bar controller is positioned horizontally in front of the keyboard and capable of movement on two axes, to control electronic parameters of the music synthesizer, comprising:

a horizontal bar that is non-specific size, dimensions or shape, and the length is approximately the width of the horizontally disposed keyboard including its enclosure;

said horizontal bar being positioned approximately one inch in front of keyboard and one half inch below a plane parallel to the top of the playing surface of the keyboard, whereby the player may move the bar up, down, and/or in and out, with the thumb of the playing hand;

a two-part telescoping lever at each end of said horizontal bar for holding said horizontal bar in the playing position, whereby part one is attached perpendicularly at each end to said horizontal bar, and part two is mounted on each side of the keyboard enclosure, holding said horizontal bar in the neutral position used for playing;

said part one of said telescoping lever is capable of sliding into or telescoping into said part two at least one inch on the x-axis, when the thumb of the playing hand applies pressure to the said horizontal bar in an inward direction (x-axis) towards the keyboard, while any of the other fingers are playing or holding a note or notes on the keyboard;

one spring or elastic mechanism, connected between said part one and part two of the said telescoping lever, which returns said part one and said horizontal bar to its neutral position, when no pressure is applied;

said part two, of said telescoping levers, is mounted on an axle within an attachment mount to each side of the keyboard enclosure, whereby the said horizontal bar can move up or down at least thirty degrees on the y axis when pressure is applied;

an additional spring or elastic mechanism, connected within the attachment mount of said part two of the said telescoping lever, which returns said part two and said horizontal bar to its neutral resting position, when no pressure is applied;

a first wiper control of a sliding potentiometer or digital encoder connected by physical or mechanical means to said part one of the said telescoping lever for changing a control voltage when pressure is applied to move said horizontal bar inward (x axis), up to one inch, towards the keyboard;

a second wiper control of a rotary potentiometer or digital encoder connected by physical or mechanical means to said part two of the said telescoping lever for changing another control voltage when pressure is applied to move said horizontal bar up or down (y axis) up to at least thirty degrees; and said sliding potentiometer, said rotary potentiometer, or said digital encoder electronic component is connected by cable or an integrated wireless transmission system to the controller circuitry in the music synthesizer, either by replacing the existing controller knobs, wheels, levers, or making a switchable option.

2. The Thumb Bar Controller in claim 1, wherein said thumb bar controller is mounted internal to the synthesizer enclosure, protruding through openings in the front of the enclosure on either side of the keyboard for movement needed of the telescoping levers, wherein said thumb bar controller becomes a permanent system, manufactured specifically for said synthesizer.

* * * * *